United States Patent [19]

Mauer

[11] Patent Number: 4,910,825

[45] Date of Patent: Mar. 27, 1990

[54] LIQUID APPLICATOR ATTACHMENT FOR A SQUEEGEE

[76] Inventor: Gary Mauer, 728 Silver Lake St., Oconomowoc, Wis. 53066

[21] Appl. No.: 239,443

[22] Filed: Sep. 1, 1988

[51] Int. Cl.[4] ..... A47L 1/08

[52] U.S. Cl. ..... 15/121; 15/209 R; 15/245

[58] Field of Search ..... 15/104.93, 104.94, 114, 15/118, 121, 209 R, 220 R, 245, 210 R, 250.01, 250.03, 236.01, 117, 111, 105, 232, 235, 244.1, 244.2; 401/261, 139, 283

[56] References Cited

U.S. PATENT DOCUMENTS

| | | | |
|---|---|---|---|
| D. 163,585 | 6/1951 | De Vore . | |
| 214,548 | 4/1879 | Bovey . | |
| 603,581 | 5/1898 | Urmston . | |
| 1,215,239 | 2/1917 | Bayless . | |
| 1,897,726 | 2/1933 | Hillyard . | |
| 2,326,576 | 8/1943 | Steinmetz | 15/105 |
| 2,552,366 | 5/1951 | Bush | 15/235 X |
| 2,625,700 | 1/1953 | Baldwin | 15/245 |
| 2,663,889 | 12/1953 | Fuglie . | |
| 2,672,638 | 3/1954 | Blum | 401/139 |
| 2,722,701 | 11/1955 | Blum et al. | 401/139 |
| 2,741,788 | 4/1956 | Shey . | |
| 2,745,126 | 5/1956 | Mora . | |
| 2,842,789 | 7/1958 | Wells . | |
| 3,368,230 | 2/1968 | Kramer | 15/245 X |
| 3,457,579 | 7/1969 | Shea | 15/245 |
| 4,016,623 | 4/1977 | Nixdorf | 15/250.03 |
| 4,124,915 | 11/1978 | Schlicher | 15/105 |
| 4,152,807 | 5/1979 | Smahlik . | |
| 4,312,093 | 1/1982 | Raab | 15/220 |
| 4,409,700 | 10/1983 | Sullivan . | |
| 4,607,411 | 8/1986 | Lewis, Jr. . | |

FOREIGN PATENT DOCUMENTS

| | | | |
|---|---|---|---|
| 6615999 | 5/1968 | Netherlands | 15/121 |

*Primary Examiner*—Harvey C. Hornsby
*Assistant Examiner*—Scott J. Haugland
*Attorney, Agent, or Firm*—Andrus, Sceales, Starke & Sawall

[57] ABSTRACT

An attachment for a squeegee includes a resilient mounting member to which a liquid applicator is connected. The liquid applicator preferably comprises a water retentive pad or the like, and the mounting member is preferably formed of a resilient material, such as plastic, which is adapted for connection to the squeegee. The resilient mounting of the pad to the squeegee urges the liquid applicator against the surface being cleaned, and the pad is maintained in a position adjacent the squeegee blade when the blade is placed on the surface.

13 Claims, 1 Drawing Sheet

FIG 1
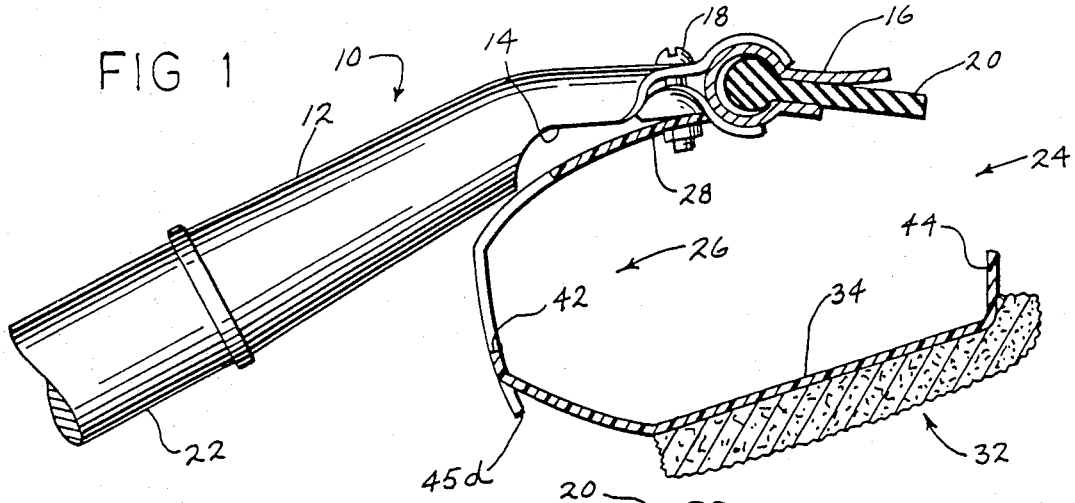
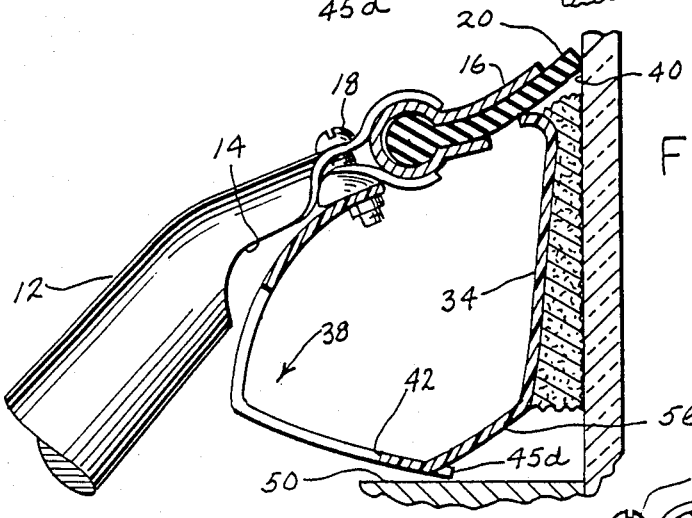
FIG. 2
FIG. 3
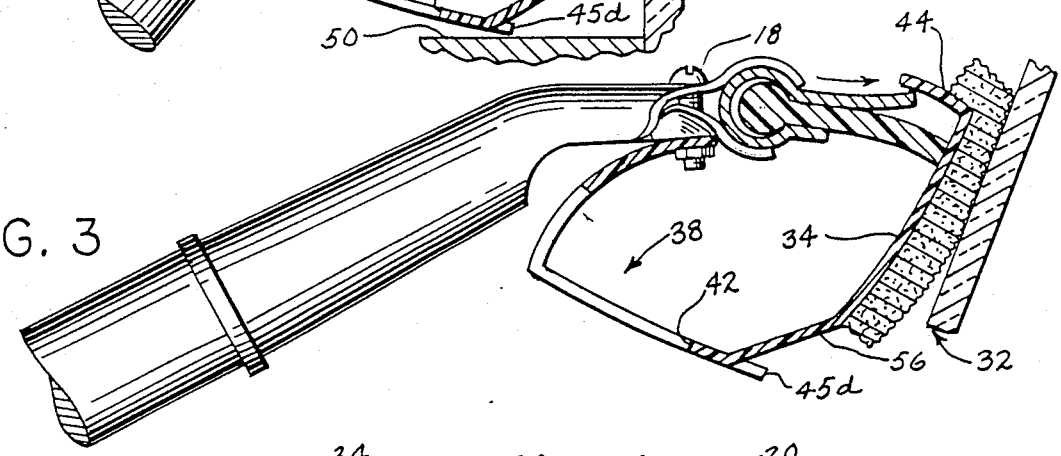
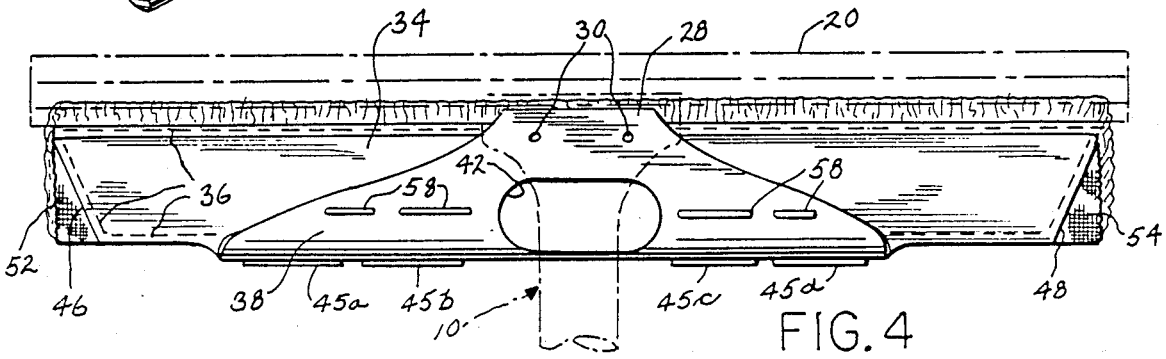
FIG. 4

LIQUID APPLICATOR ATTACHMENT FOR A SQUEEGEE

BACKGROUND AND SUMMARY

This invention relates to cleaning tools, and more particularly to a liquid applicator attachment for a squeegee or the like.

It is known to provide a structure in combination with a squeegee for applying liquid to a surface to be cleaned. Examples of such structures are shown in the following U.S. Pat. Nos.: 4,607,411 to Lewis, Jr.; 4,409,700 to Sullivan; 4,152,807 to Smahlik; and 2,842,789 to Wells.

The present invention is advantageous over the structures disclosed in the aforementioned patents by providing a liquid applicator which is resiliently mounted to the squeegee. In accordance with the invention, an attachment for a squeegee, which includes a handle to which a blade is mounted at an end thereof, includes liquid applicator means and mounting means for mounting the liquid applicator means to the squeegee. Bias means is provided between the liquid applicator means and the squeegee. When the squeegee is positioned such that the squeegee blade is disposed against a surface, the bias means acts to bias the liquid applicator means toward the surface for maintaining the liquid applicator means in contact therewith. In one embodiment, the liquid applicator means comprises a liquid retentive pad, and the mounting means comprises an integral member including a pad backing surface to which the pad is mounted, and a connector portion extending from the pad backing surface and adapted for connection to the squeegee for mounting the pad thereto. The bias means is preferably provided by forming the connector portion of a resilient material so that the pad is movable toward and away from the squeegee blade. The liquid retentive pad is preferably disposed adjacent the squeegee blade when the squeegee is in position against a surface. With this construction, the liquid retentive pad applies liquid, such as soapy water or the like, to a surface just prior to removal of such liquid from the surface by the squeegee blade. In this manner, several operational advantages are attainable, as will be explained.

The invention further contemplates a squeegee in combination with the attachment as above described.

BRIEF DESCRIPTION OF THE DRAWINGS

The drawings illustrate the best mode presently contemplated of carrying out the invention.

In the drawings:

FIG. 1 is a side elevation view of a squeegee fitted with the liquid applicator attachment of the invention, showing these components when not in use;

FIG. 2 is a view similar to FIG. 1, showing the squeegee and liquid applicator attachment of the invention in use for applying liquid to a surface to be cleaned;

FIG. 3 is a view similar to FIG. 2, showing engagement of the liquid applicator attachment by the squeegee blade for use in scrubbing a surface prior to cleaning; and FIG. 4 is a top plan view of the liquid applicator attachment of the invention, with the squeegee shown in phantom.

DETAILED DESCRIPTION OF THE PREFERRED EMBODIMENT

With reference to FIG. 1, a squeegee 10 includes a handle stub 12 having a neck portion 14, and a channel 16 mounted to neck portion 14 by means of a pair of fasteners, such as machine screws 18. A squeegee rubber or blade 20 is disposed within channel 16, as is well known. Handle stub 12 is hollow at its leftward end, so as to receive an elongated handle 22. In this manner, squeegee 10 can be used to reach surfaces which would otherwise be difficult to reach. As is known, however, squeegee 10 is also usable without handle 22, with the user simply grasping handle stub 12.

A liquid applicator attachment 24 is adapted for mounting to squeegee 10. Liquid applicator attachment 24 includes a mounting member 26, which is adapted for connection to squeegee 10. As shown in FIG. 4, mounting member 26 has a connector portion 28 which is provided with a pair of openings 30. Openings 30 are adapted to receive screws 18 therethrough for mounting of mounting member 26 to squeegee 10 adjacent blade 20. Mounting member 26 is preferably formed from a resilient plastic material which is die cut to a desired shape and formed into the shape shown in the drawing figures.

As a means for applying liquid to a surface to be cleaned, a liquid retentive pad 32 is mounted to a pad backing portion 34 of mounting member 26. Liquid retentive pad 32 is preferably formed from a cut pile fabric or the like. Pad 32 provides a liquid applicator surface, which bears against a surface being cleaned during use for applying liquid thereto. As shown in FIG. 4, pad 32 is mounted to pad backing portion 34 by means of stitches 36. It is recognized, however, that any satisfactory means may be used to affix pad 32 to pad backing portion 34.

Mounting member 26 includes a biasing portion 38 extending between connecting portion 28 and pad backing portion 34. As shown in FIG. 1, biasing portion 38 acts to maintain liquid applicator surface 33 outwardly away from the water removing edge of blade 20 when squeegee 10 is not in use. Being formed of a resilient material, biasing portion 38 of mounting member 26 allows movement of liquid applicator surface 33 into line with the outer surface of blade 20 when blade 20 is positioned against a surface to be cleaned, shown at 40 (FIG. 2). When squeegee 10 is so positioned, biasing portion 38 of mounting member 26 acts to maintain the liquid applicator surface of pad 32 in contact with surface 40 adjacent blade 20. In this manner, liquid is applied from pad 32 to surface 40 just prior to removal of such liquid from surface 40 by blade 20. Downward movement of squeegee 10 during normal use results in pad 32 being positioned immediately adjacent the underside of blade 20. Such positioning of pad 32 is the result of friction between pad 32 and surface 40 during downward movement of squeegee 10, which results in relative upward movement of pad 32. In this manner, liquid applied to surface 40 is immediately stripped therefrom by blade 20 and returned to pad 32, allowing recycling of cleaning liquid during operation.

As can be seen in FIG. 2, blade 20 and the liquid applicator surface of pad 32 are simultaneously in contact with surface 40. This feature of the invention eliminates the problem existent in prior art structures that two separate passes were required for cleaning; one for applying liquid to a surface and the other for removing such liquid therefrom. This is important on hot and dry days, as liquid is not allowed to evaporate from surface 40 before removal therefrom by squeegee 20. The invention allows squeegee 10 to be moved throughout a range of positions while maintaining contact of blade 20 with surface 40, all the while maintaining contact of at least a portion of pad 32 with surface 40. This feature of the invention accommodates overhead cleaning and any other application where squeegee 10 cannot be maintained at a constant angle relative to surface 40.

As shown in FIG. 4, an opening 42 is formed in biasing portion 38 of mounting member 26. Opening 42 acts as a detent engageable by a finger of the user when the user grips handle stub 12 of squeegee 10 during use. In this manner, the biasing force provided by biasing portion 38 of mounting member 26 can selectively be overcome by the user pulling inwardly, toward the user's body, on biasing portion 38 at opening 42. With such action, pad 32 can be removed from surface 40 during cleaning, if desired. Alternatively, the user may exert force in the same direction as that provided by biasing portion 38 so as to urge the liquid applicator surface of pad 32 against surface 40. This is accomplished by the user engaging a finger with biasing portion 38 adjacent opening 42 and pushing outwardly, i.e. away from the user's body. In this manner, additional cleaning force can be provided on the liquid applicator surface over and above that provided by biasing portion 38 alone.

To scrub stubborn spots which are not removable from surface 40 as described above, attachment 24 is movable to a scrubbing position as shown in FIG. 3. In this position, the upper leg of channel 16 is placed into engagement with an upstanding lip 44 extending substantially perpendicularly to pad backing portion 34 of mounting member 26. Upstanding lip 44 and pad backing portion 34 form an inside corner, and the outermost end of the upper leg of channel 16 is movable into engagement therewith in the direction of the arrow shown in FIG. 3. As shown, pad 32 conforms to the configuration of pad backing portion 34 and lip 44, extending around the outside corner formed by lip 44 and pad backing portion 34. With attachment 24 in the position of FIG. 3, force applied to squeegee 10 in the direction of the arrow is transferred through the upper leg of channel 16 and directly to the portion of pad 32 lying between surface 40 and the outside corner formed by lip 44 and pad backing portion 34. In this position, the effect of biasing portion 38 of mounting member 26 is bypassed so as to provide direct scrubbing of surface 40. After scrubbing in the position of FIG. 4, attachment 24 is again moved to its normal operating position (FIG. 2), and regular liquid application and removal resumed.

The blank from which mounting member 26 is formed is provided with a series of longitudinal slits, each having a small transverse slit at its ends. In this manner, when the blank is formed as shown, the slits provide a plurality of scraper surfaces, shown at 45*a*, 45*b*, 45*c* and 45*d* (FIG. 4). Scraper surfaces 45*a*–45*d* are brought into contact with surface 40 by application of finger pressure in opening 42 or on biasing portion 38 and pushing outwardly against surface 40. Scraper surfaces 45*a*–45*d* provide a supplementary means for removing stubborn material from surface 40 during scrubbing.

As shown in FIG. 3, pad backing portion 34 of mounting member 26 is substantially coextensive with the length of pad 32 at its outer edge adjacent lip 44. Sides 46, 48 of pad backing portion 34 are angled inwardly from the outer edge of pad backing portion 34, so that the inner edge of pad backing portion 34 is shorter than its outer edge. With this construction, when the squeegee/liquid applicator assembly is disposed at an angle to the horizontal during cleaning and a corner is approached, the portions of pad 32 which extend beyond angled sides 46, 48, shown at 52, 54, collapse to allow squeegee blade 20 to reach into the corner. During normal operation, such portions of pad 32 allow liquid application throughout substantially the entire length of blade 20.

Biasing portion 38 of mounting member 26 is formed such that a lower angled surface 56 is the first to meet lower surface 50 as squeegee 10 and attachment 24 are moved downwardly on surface 40. With lower angled surface 56 contacting lower surface 50, attachment 24 is "kicked" outwardly away from surface 40 during downward movement of squeegee 10 and attachment 24. In this manner, liquid is not caused to squirt sidewards or over blade 20 when lower surface 50 is approached.

The blank form which attachment 24 is formed is preferably provided with a series of slits, such as shown at 58 (FIG. 4), which are placed at each bend line. In this manner, bending of the blank to its desired position is more easily accomplished.

Various alternatives and modifications are contemplated as being within the scope of the following claims particularly pointing out and distinctly claiming the invention.

I claim:

1. A cleaning tool, comprising:

a squeegee including a handle to which a blade is mounted at an end thereof;

liquid applicator means including a liquid applicator surface; and resilient mounting member for mounting said liquid applicator means to said squeegee, said resilient mounting member including a downwardly extending first portion connectable to said squeegee and an upwardly extending second portion to which said liquid applicator means is mounted, said resilient mounting member maintaining said liquid applicator surface in a position spaced from said squeegee blade when said cleaning tool is not in use, and said resilient mounting member being adapted to flex so as to allow a substantial amount of movement of said liquid applicator surface toward said squeegee blade when said cleaning tool is in use and said squeegee blade is positioned against a surface, said resilient mounting member acting to maintain said liquid applicator surface in contact with said surface and adjacent said squeegee blade for applying liquid to said surface just prior to removal of liquid from said surface by said squeegee blade.

2. The cleaning tool according to claim 1, wherein said liquid applicator means comprises a liquid retentive pad.

3. The cleaning tool according to claim 2, wherein said pad extends along substantially the entire length of said squeegee blade.

4. The cleaning tool according to claim 3, wherein said pad backing surface is coextensive at its outer edge with said pad.

5. A cleaning tool, comprising:

a squeegee including a handle and a blade mounted at an end thereof;

liquid applicator means mounted to said squeegee, comprising a liquid retentive pad and mounting means for mounting said pad to said squeegee, said mounting means including a pad backing surface to which said pad is mounted, said pad extending along substantially the entire length of said squeegee blade and said pad backing surface being substantially coextensive at its outer edge with said pad, and wherein the sides of said pad backing surface are angled inwardly away from the outer edge thereof so that the inner edge of said pad backing surface extends less than the length of the outer edge of said pad backing surface, and wherein said pad extends beyond said angled sides of said pad backing surface; and bias means comprising a resilient member extending between said squeegee and said pad backing surface for biasing said liquid applicator means toward a surface for maintaining said liquid applicator means in contact with said surface when said squeegee is positioned such that said squeegee blade is disposed thereagainst.

6. The cleaning tool according to claim 1, further comprising detent means provided on said resilient mounting member for engagement by a user's finger, said finger engagement acting to supplement the bias provided by said resilient mounting member or to overcome such bias for controlling the operation of said cleaning tool during use.

7. The cleaning tool according to claim 6, wherein said detent means comprises an opening formed in said resilient mounting member for engagement by a user's finger.

8. A cleaning tool, comprising:

a squeegee including a handle and a blade mounted at an end thereof;

liquid applicator means mounted to said squeegee comprising a liquid retentive pad and mounting means for mounting said pad to said squeegee, wherein said mounting means includes a pad backing surface to which said pad is mounted;

bias means comprising a resilient member extending between said squeegee and said pad backing surface for biasing said liquid applicator means toward a surface for maintaining said liquid applicator means in contact with said surface when said squeegee is positioned such that said squeegee blade is disposed thereagainst; and engagement means engageable with said squeegee and interconnected with said pad, said resilient member providing movement of said cleaning tool to a scrubbing position in which said engagement means is engaged with said squeegee such that force applied on said squeegee toward said surface is transferred through said engagement means to said pad.

9. The cleaning tool according to claim 8, wherein said engagement means comprises an upstanding lip formed on said pad backing surface with which said squeegee blade is engageable for attaining said scrubbing position.

10. The cleaning tool according to claim 1, further comprising scraper means formed integrally with said resilient mounting member for scraping said surface.

11. The cleaning tool according to claim 1, wherein said liquid applicator means comprises a liquid retentive pad, and wherein said resilient mounting member comprises a resilient plastic member and said upwardly extending second portion includes a pad backing portion to which said liquid retentive pad is mounted, with said resilient plastic member acting to urge the liquid applicator surface of said pad toward said surface for maintaining contact therewith when said cleaning tool is in use.

12. An attachment for a squeegee or the like including a handle to which a blade is mounted at an end thereof, comprising:

liquid applicator means including a liquid applicator surface; and a resilient mounting member for mounting said liquid applicator means to said squeegee, said resilient mounting member including a downwardly extending first portion connectable to said squeegee and an upwardly extending second portion to which said liquid applicator means is mounted, said resilient mounting member maintaining said liquid applicator surface in a position spaced from said squeegee blade when not in use, and said resilient mounting member being adapted to flex so as to allow a substantial amount of movement of said liquid applicator surface toward said squeegee blade when in use and said squeegee blade is positioned against a surface, said resilient mounting member acting to maintain said liquid applicator surface in contact with said surface and adjacent said squeegee blade for applying liquid to said surface just prior to removal of liquid from said surface by said squeegee blade.

13. The attachment according to claim 12, wherein said liquid applicator means comprises a liquid retentive pad, and wherein said upwardly extending second portion includes a backing surface to which said pad is mounted.

* * * * *